United States Patent [19]

Albertson

[11] 4,271,016

[45] Jun. 2, 1981

[54] SEDIMENT INDICATOR FOR LIQUID CIRCULATORY SYSTEM

[76] Inventor: Robert V. Albertson, 2100 Shadywood Rd., Wayzata, Minn. 55391

[21] Appl. No.: 34,267

[22] Filed: Apr. 30, 1979

[51] Int. Cl.[3] ..... B01D 21/00

[52] U.S. Cl. ..... 210/94; 210/167

[58] Field of Search ..... 210/94, 95, 167

[56] References Cited

U.S. PATENT DOCUMENTS

| | | | |
|---|---|---|---|
| 1,933,409 | 10/1933 | Berman | 210/94 |
| 2,389,814 | 11/1945 | Pond et al. | 210/94 |
| 2,708,596 | 5/1953 | Weller | 237/8 R |
| 3,188,004 | 6/1965 | Falk | 237/8 R |
| 3,360,128 | 12/1967 | Federline | 210/94 |

FOREIGN PATENT DOCUMENTS

| | | | |
|---|---|---|---|
| 160500 | 1/1955 | Australia | 210/94 |

*Primary Examiner*—John Adee

*Attorney, Agent, or Firm*—Burd, Bartz & Gutenkauf

[57] ABSTRACT

A sediment indicator for installation in a fluid flow line of a fluid circulatory system such as a liquid cooling system for an internal combustion engine to serve to give visual indication of when the fluid medium has become dirty and is in need of cleaning or replacement. The indicator includes the tubular open-ended member insertable in a fluid flow line of the circulatory system to provide a fluid passage that is in fluid communication with the flow of fluid in a system. The indicator includes a housing portion having a sediment depository or chamber open to the flow passage of the tubular member and in depending relationship to it. The housing is at least partially transparent to permit visual inspection of the chamber. Sediment entrained in the circulating fluid medium as it passes in the fluid passage of the tubular member drops under the influence of gravity into the chamber where it can be viewed from without the housing. Collection of a predetermined amount of sediment in the chamber is indicative that fluid medium needs to be cleaned or replaced.

3 Claims, 9 Drawing Figures

FIG.1
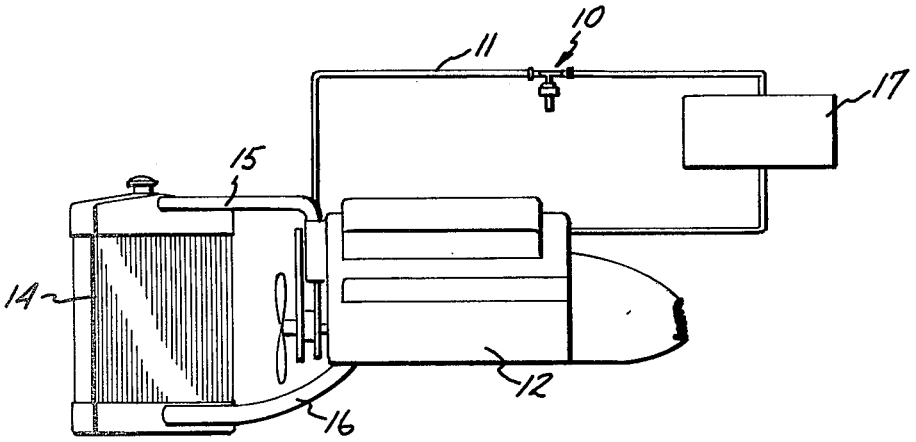
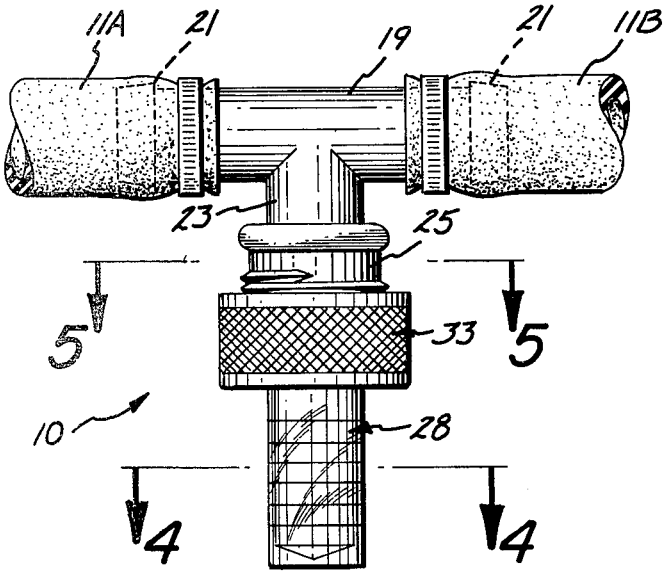
FIG.2
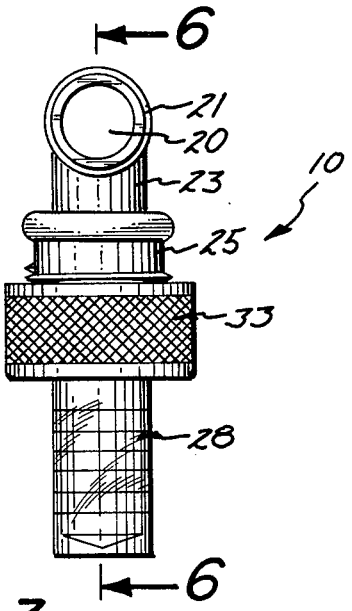
FIG.3
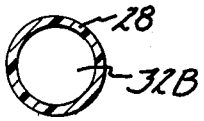
FIG.4
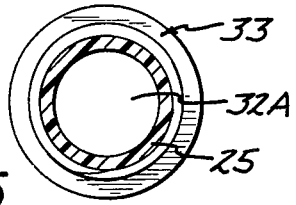
FIG.5

FIG. 6
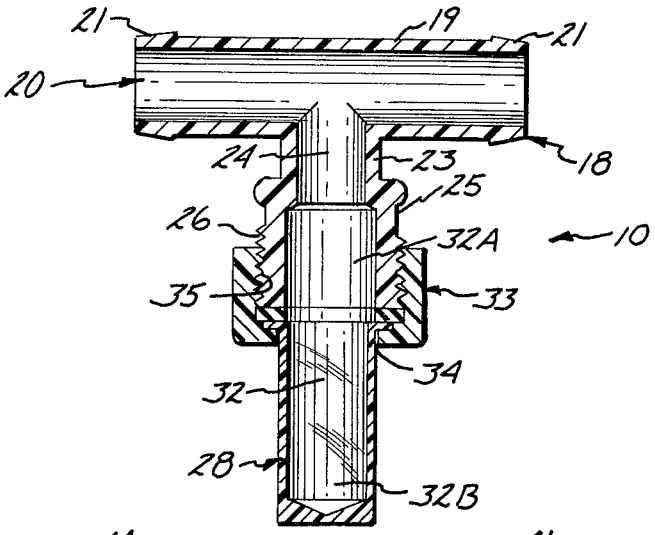
FIG. 7
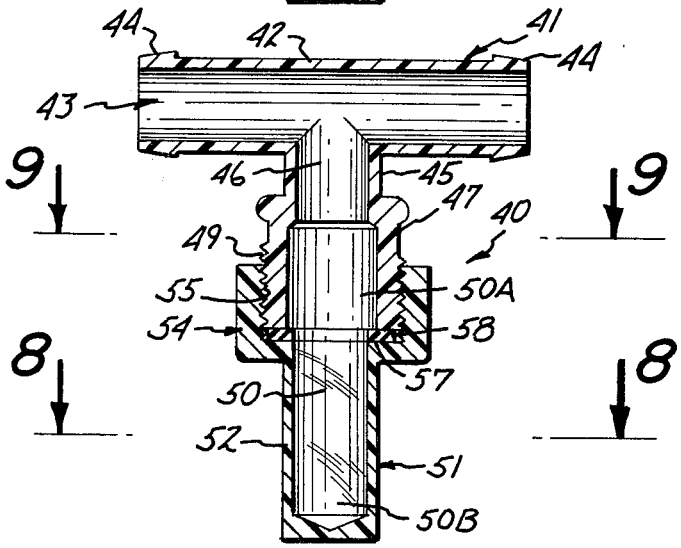
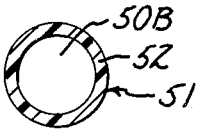
FIG. 8
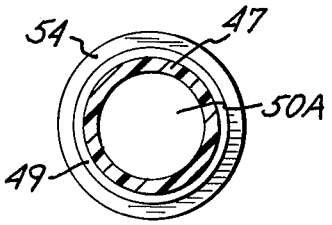
FIG. 9

SEDIMENT INDICATOR FOR LIQUID CIRCULATORY SYSTEM

SUMMARY OF THE INVENTION

In a fluid circulating system such as the liquid cooling system of an internal combustion engine, the fluid medium requires periodic changing or cleaning as it is prone to collect sediment such as dirt and rust particles at it circulates through the system. It is conventional and necessary practice to clean and flush radiators, heater cores, and blocks of internal combustion engines to flush foreign matter and sediment such as scale, sludge, dirt and deposits that accumulate therein. Current automobile engines are equipped with smaller capacity cooler systems to reduce weight. These cooling systems are operated under higher temperatures and pressure to increase cooling rate and efficiency. The systems must be periodically cleaned to insure sufficient heat transfer and liquid circulation. The usual method of attempting to determine when the fluid medium needs cleaning or replacement is simply to visually inspect the liquid by removal of the radiator cap and viewing the liquid contained therein. At best, this method gives only an approximation of when the fluid should be replaced or cleaned. Too frequent cleaning or replacement of the fluid is unnecessarily expensive, yet too infrequent cleaning or replacement can result in damage and malfunction.

The invention pertains to a sediment indicator to permit visual indication of when an amount of sediment has collected in the circulating fluid sufficient to warrent cleaning or replacement. The invention includes an open-ended tubular member having an axial flow passage and being insertable in a fluid flow line of a circulating system. Fluid flowing in the circulating system flows through the axial passage of the tubular member in the normal course of circulation throughout the system. An indicator housing defines a sediment depository or chamber and is open to the tubular member. The housing is at least partially transparent to permit viewing of the chamber interior. Sediment entrained in the circulating fluid medium passes with the fluid through the fluid passage of the tubular members in the normal course of circulating through the system. As the sediment passes over the opening to the depository chamber, some of the sediment is drawn into the chamber under the influence of gravity. Over a period of time, the amount of sediment located in the chamber builds up and is observable from without the chamber. Collection of a predetermined amount of sediment in the chamber is indicative that the fluid medium is in need of cleaning or changing.

IN THE DRAWINGS

FIG. 1 is a side elevational view of an internal combustion engine system having a sediment indicator according to a first form of the present invention installed in a fluid flow line of the liquid coolant circulatory system;

FIG. 2 is an enlarged front elevational view of the sediment indicator shown in FIG. 1;

FIG. 3 is a side view of the sediment indicator shown in FIG. 2;

FIG. 4 is a sectional view of a portion of the sediment indicator of FIG. 3 taken along the line 4—4 thereof;

FIG. 5 is a sectional view of a portion of the sediment indicator of FIG. 2 taken along the line 5—5 thereof;

FIG. 6 is a sectional view of the sediment indicator as shown in FIG. 3 taken along the line 6—6 thereof;

FIG. 7 is a sectional view of a sediment indicator similar to that shown in FIG. 6 showing a second form of the invention;

FIG. 8 is a sectional view of a portion of the sediment indicator of FIG. 7 taken along the line 8—8 thereof; and FIG. 9 is a sectional view of a portion of the sediment indicator of FIG. 7 taken along the line 9—9 thereof.

DESCRIPTION OF PREFERRED EMBODIMENTS

Referring to the drawings, there is shown in FIG. 1 a sediment indicator 10 according to a first form of the invention installed in a fluid flow line 11 of a cooling fluid circulatory system of an internal combustion engine 12. Internal combustion engine 12 has a circulatory system including the usual radiator 14 for storage and cooling of the liquid medium circulated through engine 12. Input and output hoses 15,16 deliver coolant between the radiator 14 and the engine 12. Fluid flow line 11 is disposed between one end of the block of engine 12, passing through a heater core 17, and entering the opposite end of the block of engine 12. Coolant fluid circulates under pressure through radiator 14, hoses 15,16, the block of engine 12, flow line 11 and heater core 17. As it does, it accumulates sediment in the form of scale, sludge, dirt and other deposits. For this reason the coolant must periodically be cleaned or replaced. Sediment indicator 10 serves to provide a visual indication of when the coolant fluid should be cleaned or replaced.

Referring to FIGS. 2 through 6, sediment indicator 10 has a generally T-shaped member 18 with an elongate leg comprised as a transverse open-ended tubular member 19 defining a fluid passage 20. As shown in FIG. 2, fluid line 11 is split forming ends 11A and 11B which are snugly fitted over respective ends of tubular member 19. The respective ends of of tubular member 19 have raised circumferencial sloped ridges 21 which assist in maintaining the ends 11A, 11B of fluid line 11 in engagement with the respective ends of tubular member 19. Fluid passage 20 is thus disposed in the fluid flow path of fluid moving through the fluid line 11 in the path of normal fluid circulation through the system.

A second leg of T-shaped member 18 or neck 23 extends from tubular member 19 and has a connecting passage 24 open to the fluid passage 20 of tubular member 19. An enlarged head 25 extends from the neck 23 and carries external threads 26. A generally cylindrical housing 28 has a flanged lip 29 abutted against the outer edges of head 25. A resilient sealing washer 30 is disposed between the flange lip 29 of housing 28 and the outer edges of enlarged head 25. Enlarged head 25 and housing 28 have co-extensive openings or chambers 32A, 32B which together form a sediment depository chamber 32 open to the fluid passage 20 by means of the connecting passage 24 in neck 23.

Sediment housing 28 is releasably secured with respect to the enlarged head 25 by a cap 33. Cap 33 has an opening 34 defined by an edge that permits passage of the body of housing 28 but intercepts the flanged lip 29. Cap 33 has interior threads 35 which are engagable with the exterior threads 26 on the enlarged head 25. With the cap 33 threaded onto the enlarged head 25, and engaged with the flange 29 of housing 28, housing 28 is firmly joined to the head 25 with a fluid seal provided by the washer 30. Chamber 32 is open only to the fluid passage 20 of tubular member 19.

At least a portion of the side wall of the housing 28 is transparent to permit viewing into the chamber 32. For example, housing 28 can be constructed of glass, plexiglass or other clear plastic, as can be the tubular member 19, neck 23 and enlarged head 25. As shown in FIG. 1, sediment indicator 10 is installed with respect to fluid flow line 11 with the housing 32 in depending relationship from the flow of fluid as it moves through the fluid passage 20 of tubular member 19. As the fluid moves therethrough, a certain amount of sediment contained in the fluid drops into the chamber 32. This amount of sediment is observable from without the housing 28. When a predetermined amount of sediment has collected in the chamber 32, as viewed through the side wall of the housing 28, this is indicative that it is time to either replace or clean the circulating fluid. After this has been accomplished, the chamber 32 is emptied by disengagement of the cap 30 from enlarged head 25 whereupon the housing 28 can be cleaned along with the enlarged head 25, the neck 23 and the tubular member 19.

A modified form of the invention is indicated generally at 40 in FIGS. 7 through 9. Sediment indicator 40 includes a T-shaped member 41 having an elongate tubular member 42 with a fluid flow passage 43. The respective ends of the tubular member 42 have raised circumferencial sloped ridges 44 for engagement with split ends of a fluid flow line of a circulatory system. A neck 45 extends from the tubular member 42 and defines a connecting passage 46 open to the fluid flow passage 43. An enlarged head 47 extends from the neck 45 and carries exterior threads 49. Enlarged head 47 defines an interior chamber 50A which is connected to the connecting passage 46. A housing 52 is removably assembled to the T-member 41. Housing 51 includes a base portion 52 having a second chamber 50B coextensive with the chamber 50A of the enlarged head 47 to form a sediment collecting chamber 50. The end of housing 51 assembled to the T-member 41 is provided with an integral enlarged cap or boss 54 having integral threads 55 which fit on the external threads 49 of enlarged head 47. Cap 54 is provided with a shoulder 57 which abutts the outer edge of enlarged head 47 when cap 54 is threaded thereon. A resilient washer 58 is disposed between the shoulder 57 and outer edge of the enlarged head 47 to provide a fluid tight seal.

At least a portion of the side wall of the housing 51 is transparent to permit viewing of the chamber 50 from without. As fluid flows through the flow passage 43 of T-member 41, some of the entrained sediment drops into the chamber 50. This can be viewed from time to time to determine the amount of sediment that has been deposited. A predetermined amount of sediment deposit, it indicative that it is time to clean or change the circulating medium. After this has been accomplished, the housing 51 is removed from the T-member 41 for purposes of cleaning, and then replaced.

While there has been shown and described two forms of a sediment indicator according to the invention, it will be apparent to those skilled in the art that deviations can be had from those forms shown without departing from the scope and spirit of the appended claims.

The embodiments of the invention in which an exclusive property or privilege is claimed are defined as follows:

1. A sediment indicator to provide visual indicia of the amount of sediment contained in the fluid medium of a fluid circulatory system having a fluid flow line, comprising:

a generally T-shaped member with a first elongate leg comprised as a transverse open ended tubular member defining an unobstructed fluid flow passage having opposed open ends to be insertable in a fluid flow line of a fluid circulating system with said fluid flow passage disposed in a normal circulatory flow path of fluid in the circulatory system when the tubular member is inserted in said fluid flow line, said unobstructed passage having a diameter substantially the same as said flow line so as to minimize disruption of normal flow line flow, said T-shaped member having a second leg including a neck extending from the tubular member and having an unobstructed connecting passage open to said fluid flow passage of the tubular member;

said connecting passage having a diameter substantially equal to that of said flow passage;

an enlarged cylindrical head extending from said neck;

a cylindrical housing connected to the head and having a cylindrical sediment depository chamber open to said fluid flow passage of the tubular member such that at least some sediment in fluid circulating through the fluid flow line is capable of entering the chamber through said unobstructed, full diameter passages;

said housing having a side wall at least partially transparent to permit viewing into the chamber from without the housing to determine the amount of sediment collected in the chamber, and means detachably connecting said housing to said T-shaped member in sealed relation thereto by interengagement with the enlarged head of said second leg of said T-shaped member to abut a portion of said housing against said enlarged head.

2. The sediment indicator of claim 1 wherein said housing connecting means includes an outwardly extending flange on said housing in confronting relation to the terminal end of said enlarged head, and an internally threaded annular cap cooperating with external threads on said enlarged head, said cap including an annular portion bearing axially against said housing flange to clamp the same with respect to said terminal end.

3. The sediment indicator of claim 1 wherein said housing connecting means includes an outwardly extending flange on said housing in confronting relation to the terminal end of said enlarged head, said flange merging into an annular axially extending internally threaded cap portion of said housing, said cap having internal threads cooperating with external threads on said enlarged head, thereby to clamp said housing flange with respect to said terminal end.

* * * * *